US009342045B2

(12) United States Patent
Fukuda

(10) Patent No.: US 9,342,045 B2
(45) Date of Patent: May 17, 2016

(54) IMAGE FORMING APPARATUS HAVING FIXING UNIT DETACHABLY MOUNTABLE TO A MAIN ASSEMBLY OF THE APPARATUS

(71) Applicant: CANON KABUSHIKI KAISHA, Tokyo (JP)

(72) Inventor: Takeshi Fukuda, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/480,966

(22) Filed: Sep. 9, 2014

(65) Prior Publication Data

US 2015/0071680 A1 Mar. 12, 2015

(30) Foreign Application Priority Data

Sep. 12, 2013 (JP) ..... 2013-189646

(51) Int. Cl.
*G03G 21/16* (2006.01)

(52) U.S. Cl.
CPC ..... *G03G 21/1685* (2013.01); *G03G 21/1647* (2013.01)

(58) Field of Classification Search
CPC ..... G03G 21/1685; G03G 21/1647
USPC ..... 399/122
See application file for complete search history.

(56) References Cited

U.S. PATENT DOCUMENTS 4,760,411 A * 7/1988 Ohmura ..... G03G 15/2092 347/152
5,305,065 A * 4/1994 Hoover ..... G03G 15/2064 219/216
5,708,926 A * 1/1998 Sagara et al. ..... 399/122
6,314,256 B1 * 11/2001 Saitoh ..... 399/122
8,554,097 B2 10/2013 Hara et al.
8,781,364 B2 7/2014 Fukuda et al.
2003/0143003 A1 * 7/2003 Stringham ..... G03G 15/20 399/328
2009/0232550 A1 * 9/2009 Obata ..... G03G 21/1685 399/122

(Continued)

FOREIGN PATENT DOCUMENTS

JP 2005-37672 A 2/2005

OTHER PUBLICATIONS

U.S. Appl. No. 14/469,857, filed on Aug. 27, 2014.

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An electrophotographic image forming apparatus includes: a main assembly; and a fixing unit. The main assembly includes an advancing-and-retracting member capable of advancing and retracting in a direction substantially perpendicular to a mounting direction of the fixing unit, and includes an urging member configured to urge the advancing-and-retracting member in an advancing direction. The fixing unit includes an engaging member engageable with the advancing-and-retracting member. The engaging member includes i) a retracting portion configured to retract the advancing-and-retracting member against an urging force of the urging member with a mounting operation to the main assembly, and ii) permitting portion configured to a) permit advance of the advancing-and-retracting member by the urging portion with a further mounting operation to the main assembly and b) receive a force for moving the fixing unit in a mounting direction by the advancing-and-retracting member.

12 Claims, 7 Drawing Sheets

(56) References Cited

U.S. PATENT DOCUMENTS

2012/0020701 A1* 1/2012 Sato ..... G03G 21/1633 399/122
2013/0077993 A1* 3/2013 Arikawa et al. ..... 399/122
2013/0142552 A1* 6/2013 Yoshida ..... G03G 15/2085 399/329
2014/0153965 A1* 6/2014 Nanno ..... 399/122
2014/0314438 A1* 10/2014 Maeda ..... G03G 21/1685 399/92
2015/0063868 A1* 3/2015 Fukuda ..... G03G 15/2028 399/122

* cited by examiner (a)

(b)

(a)

(b)

IMAGE FORMING APPARATUS HAVING FIXING UNIT DETACHABLY MOUNTABLE TO A MAIN ASSEMBLY OF THE APPARATUS

FIELD OF THE INVENTION AND RELATED ART

The present invention relates to an electrophotographic image forming apparatus.

In a conventional electrophotographic image forming apparatus, a toner image is formed on a sheet (recording material) by using an electrophotographic process and then is fixed by a fixing device (fixing unit).

In such an image forming apparatus, it is desirable that a unit such as the fixing device is made detachably mountable to an image forming apparatus main assembly to permit replacement thereof with a new unit. Therefore, in an apparatus described in Japanese Laid-Open Patent Application (JP-A) 2005-37672, the unit is fixed inside the apparatus main assembly by locking, after the unit is mounted in the apparatus main assembly, a lever in a hole (portion) of a frame of the apparatus main assembly by rotating the lever provided in the unit by a user.

In this way, in the apparatus described in JP-A 2005-37672, when the user fix the unit inside the apparatus main assembly, the user is required to rotate the lever after the unit is inserted into the apparatus main assembly, so that the user is formed to perform a complicated operation.

Accordingly, when the user fixes the unit in the apparatus main assembly, it is required that an operation by the user is simpler.

SUMMARY OF THE INVENTION

According to an aspect of the present invention, there is provided an electrophotographic image forming apparatus comprising: a main assembly including an image forming portion by which a toner image is to be formed on a sheet; and a fixing unit, detachably mountable to the main assembly, configured to fix the toner image formed on the sheet by the image forming portion, wherein the main assembly includes an advancing-and-retracting member capable of advancing and retracting in a direction substantially perpendicular to a mounting direction of the fixing unit, and includes an urging member configured to urge the advancing-and-retracting member in an advancing direction, and wherein the fixing unit includes an engaging member engageable with the advancing-and-retracting member, wherein the engaging member includes a retracting portion configured to retract the advancing-and-retracting member against an urging force of the urging member with a mounting operation to the main assembly and includes a permitting portion configured to permit advance of the advancing-and-retracting member by the urging portion with a further mounting operation to the main assembly and configured to receive a force for moving the fixing unit in a mounting direction by the advancing-and-retracting member.

According to another aspect of the present invention, there is provided an electrophotographic image forming apparatus comprising: main assembly; and a fixing unit detachably mountable to the main assembly, wherein the main assembly includes an advancing-and-retracting member capable of advancing and retracting in a direction substantially perpendicular to a mounting direction of the unit, and includes an urging member configured to urge the advancing-and-retracting member in an advancing direction, and wherein the unit includes an engaging member engageable with the advancing-and-retracting member, wherein the engaging member includes a retracting portion configured to retract the advancing-and-retracting member against an urging force of the urging member with a mounting operation to the main assembly and includes a permitting portion configured to permit advance of the advancing-and-retracting member by the urging portion with a further mounting operation to the main assembly and configured to receive a force for moving the unit in a mounting direction by the advancing-and-retracting member.

These and other objects, features and advantages of the present invention will become more apparent upon a consideration of the following description of the preferred embodiments of the present invention taken in conjunction with the accompanying drawings.

DESCRIPTION OF THE EMBODIMENTS

In the following, Embodiments for carrying out the present invention will be specifically described with reference to the drawings. In this embodiment, as an example of an electrophotographic image forming apparatus, a full-color printer of a tandem type is described. However, the electrophotographic image forming apparatus according to the present invention is not limited to the full-color printer of the tandem type but may also be an electrophotographic image forming apparatus for forming a monochromatic image or a mono-color image.

Figure 1:
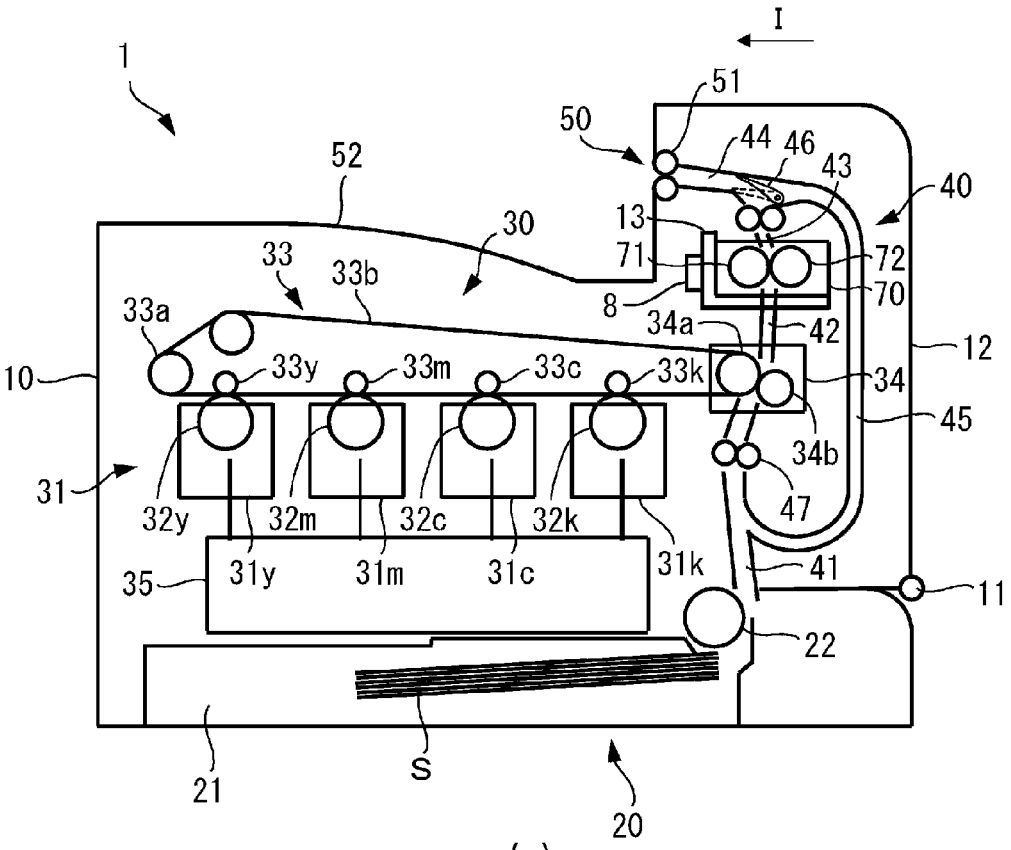
In FIG. 1, (a) is a sectional view of an apparatus main assembly, and (b) is an illustration of a controller.
Figure 1:
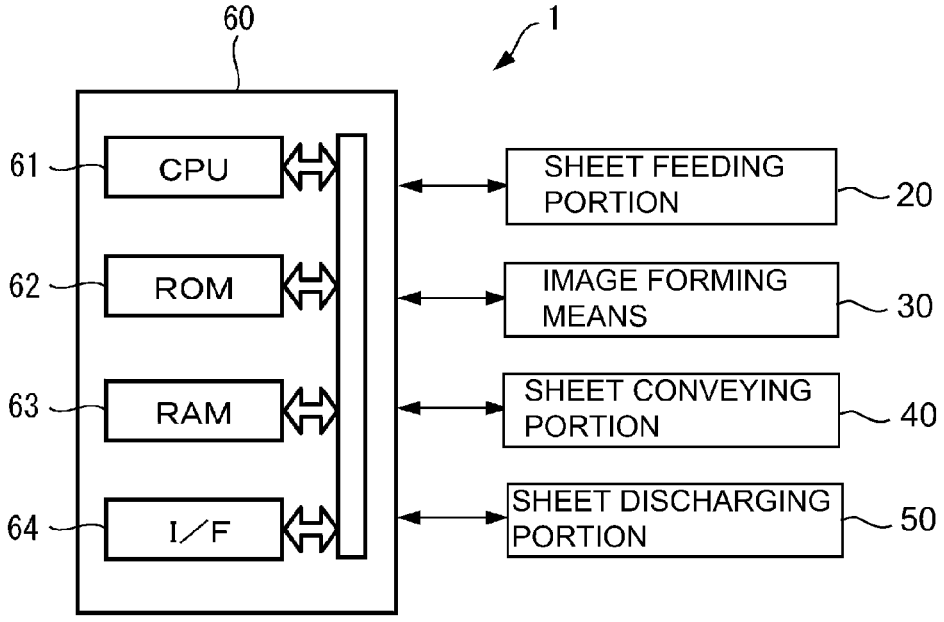

As shown in FIG. 1, an image forming apparatus 1 includes an image forming apparatus main assembly 10. Further, the apparatus main assembly 10 has a frame structure in which a sheet feeding portion 20, an image forming portion 30, a sheet conveying portion 40, a sheet discharging portion 50, a controller 60 and a fixing device 70 are incorporated. On a sheet S as a recording material, a toner image is to be formed, and specific examples of the sheet S may include plain paper, a resin material sheet, thick paper, a sheet for an overhead projector, and the like.

The sheet feeding portion 20 is disposed at a lower portion of the apparatus main assembly 10, and includes a sheet cassette 21 for stacking and accommodating the sheet S such as recording paper and includes a feeding roller 22. The sheet feeding portion 20 feeds the sheet S to the image forming portion 30.

The image forming portion 30 includes an imaging portion 31, a laser scanner 35, an intermediary transfer unit 33 and a secondary transfer portion 34 and performs the function of forming the toner image on the sheet S. The fixing device 70 as an example of the unit performs the function of fixing the toner image formed on the sheet S by the image forming portion 30.

The imaging portion 31 includes four imaging (image forming) units 31*y*, 31*m*, 31*c* and 31*k* for forming toner images of four colors of yellow (y), magenta (m), cyan (c) and black (k), respectively. Each of the image forming units is detachably mountable to the apparatus main assembly 10 by the user. For example, the image forming unit 31*y* includes a photosensitive drum 32*y* as an image bearing member on which the toner image is to be formed, an unshown charging roller, an unshown developing roller, an unshown drum cleaning blade, an unshown toner, and the like. Other image forming units 31*m*, 31*c* and 31*k* have the same structure, and therefore will be omitted from detailed eescription.

The laser scanner 35 is an exposure means for exposing surfaces of the photosensitive drums 32*y*, 32*m*, 32*c* and 32*k* to light form electrostatic latent images on the surfaces of the photosensitive drums 32*y*, 32*m*, 32*c* and 32*k*.

The intermediary transfer unit 33 is disposed above the image forming units 31*y*, 31*m*, 31*c* and 31*k*. The intermediary transfer unit 33 includes a driving roller 33*a*, a plurality of primary transfer rollers 33*y*, 33*m*, 33*c* and 33*k*, and an intermediary transfer belt 33*b* wound around there rollers. The primary transfer rollers 33*y*, 33*m*, 33*c* and 33*k* are disposed opposed to the photosensitive drums 32*y*, 32*m*, 32*c* and 32*k*, respectively, and are disposed in contact with the intermediary transfer belt 33*b*. A positive transfer bias is applied to the intermediary transfer belt 33*b* by the primary transfer rollers 33*y*, 33*m*, 33*c* and 33*k*, whereby toner images having a negative polarity are superposedly transferred successively from the photosensitive drums 32*y*, 32*m*, 32*c* and 32*k* onto the intermediary transfer belt 33*b*. As a result, a full-color image is formed on the intermediary transfer 33*b*.

The secondary transfer portion 34 includes a secondary transfer inner roller 34*a* and a secondary transfer outer roller 34*b*. By applying a positive secondary transfer bias to the secondary transfer outer roller 34*b*, the full-color image formed on the intermediary transfer belt 33*b* is transferred onto the sheet S. The secondary transfer inner roller 34*a* stretches the intermediary transfer belt 33*b* at an inside of the intermediary transfer belt 33*b*, and the secondary transfer outer roller 34*b* is provided at a position opposing the secondary transfer inner roller 34*a* via the intermediary transfer belt 33*b*.

The fixing device 70 includes a fixing roller 71 and a pressing roller 72. The sheet S is nipped and conveyed between the fixing roller 71 and the pressing roller 72, so that the toner image transferred on the sheet S is pressed and heated to be fixed on the sheet S. The fixing device 70 constitutes a single unit and is also referred to as a fixing unit. The fixing device 70 is detachably mountable to the apparatus main assembly 10 with respect to a left-right direction (insertion direction I). A detailed structure of the fixing device 70 will be described later.

The apparatus main assembly 10 includes a main assembly frame 13 supporting the fixing device 70. A unit fixing device 8 is provided between the fixing device 70 and the main assembly frame 13 so as to fasten these members. That is, the image forming apparatus 1 includes the unit fixing device 8 and the image forming portion 30. A detailed structure of the unit fixing device 8 will be described later.

The sheet conveying portion 40 includes are pre-secondary transfer conveying path 41, a pre-fixing conveying path 42, a post-fixing conveying path 43, a discharging path 44, and a (re-)conveying path 45. The sheet conveying portion 40 conveys the sheet S, fed from the sheet feeding portion 20, from the image forming portion 30 to the sheet discharging portion 50.

The pre-secondary transfer conveying path 41 is configured to convey the sheet S, fed from the sheet feeding portion 20, to the secondary transfer portion 34. The pre-secondary transfer conveying path 41 is provided with a registration roller pair 47 by which the sheet S is once received and is corrected so as to move in a straight line in the case where the sheet S moves obliquely. The pre-fixing conveying path 42 is configured to convey the sheet S, conveyed to the secondary transfer portion 34, from the secondary transfer portion 34 to the fixing device 70. The post-fixing conveying path 43 is configured to convey the sheet S, conveyed to the fixing device 70, from the fixing device 70 to a flapper 46.

The discharging path 44 conveys the sheet S, conveyed to the flapper 46, from the flapper 46 to the sheet discharging portion 50. The feeding path 45 is configured to reverse a feeding direction of the sheet S at the discharging path 44 to convey the sheet S again to the image forming portion 30 in order to form an image on a back surface of the sheet S on which the image is formed at the front surface by the image forming portion 30.

The sheet discharging portion 50 includes a discharging roller pair 51 provided in a downstream side of the discharging path 44 and includes a face-down tray 52 provided in a downstream side of the discharging roller pair 51. The discharging roller pair 51 discharges the sheet S, conveyed from the discharging path 44, to the face-down tray 52.

As shown in (b) of FIG. 1, the controller 60 is constituted by a computer and, e.g., includes CPU 61, ROM 62 for storing a program for controlling respective portions, RAM 63 for temporarily storing data, and an input-and-output circuit (I/F) 64 for inputting and outputting signals relative to an external device. The controller 60 is connected via the input-and-output circuit 64 with each of the sheet feeding portion (means) 20, the image forming portion 30, the sheet conveying portion 40 and the sheet discharging portion 50, and transfers signals with the respective portions and controls operations of the respective portions.

An image forming operation and a (sheet) feeding operation in the image forming apparatus 1 constituted as described above will be described with reference to (a) of FIG. 1.

When the image forming operation is started, first, on the basis of image information sent from an unshown personal computer or the like, the laser scanner 35 emits laser light toward the surface of each of the photosensitive drums 32*y*, 32*m*, 32*c* and 32*k*. The surface of each of the photosensitive drums 32*y*, 32*m*, 32*c* and 32*k* is electrically charged uniformly to a predetermined polarity and a predetermined potential, and an electric charge of a portion exposed to the laser light is attenuated, so that an electrostatic latent image is formed. Further, this electrostatic latent image is developed with associated one of toners of yellow, magenta, cyan and black supplied from developing rollers, so that the electrostatic latent image is visualized as a toner image.

The respective color toner images are successively transferred onto the intermediary transfer belt 33*b* by primary transfer biases applied to the primary transfer rollers 33*y*, 33*m*, 33*c* and 33*k*, so that a full-color toner image is formed on the surface of the intermediary transfer belt 33*b*.

On the other hand, in parallel with this toner image forming operation, only one sheet S is separated and fed from a plurality of sheets S accommodated in the sheet cassette 21. Then, at the secondary transfer portion 34, the registration roller pair 47 is driven at timing when the full-color toner image formed on the intermediary transfer belt 33*b* and a position of the sheet S coincide with each other. As a result, the sheet S is conveyed to the secondary transfer portion 34, and at the secondary transfer portion 34, the full-color toner image is collectively transferred onto the sheet S by a secondary transfer bias applied to the secondary transfer outer roller 34*b*.

The sheet S on which the full-color toner image is transferred in this way is conveyed to the fixing device 70, and the respective color toners are melted and mixed by being heated and pressed in the fixing device 70, so that the toners are fixed as the full-color toner image on the sheet S. Thereafter, the sheet S on which the image is fixed is discharged by the sheet discharging portion 50 provided downstream of the fixing device 70.

The apparatus main assembly 10 is provided, at a side surface in the sheet conveying portion 40 side, with an outer cover 12 openable by rotation about a hinge 11 provided at a lower portion thereof. The outer cover 12 is provided with a pair of wall portions which oppose each other and which form the feeding path 45 therebetween. The outer cover 12 is provided with wall portions, in one side (right side in FIG. 1), which form the pre-secondary transfer conveying path 41, the pre-fixing conveying path 42, the post-fixing conveying path 43 and the discharging path 44.

When the outer cover 12 is opened, a path from the pre-secondary transfer conveying path 41 to the discharging roller pair 51 except for the fixing device 70 is opened. As a result, by opening the outer cover 12, it is possible to perform clearance (removal) of the sheet S jammed in the conveying path and maintenance or the like.

When the outer cover 12 is open, the fixing device 70 fixed on the main assembly frame 13 is exposed. As a result, the user is capable of mounting and dismounting the fixing device 70 for maintenance and exchange.

The fixing device 70 and the main assembly frame 13 will be specifically described with reference to FIGS. 2 to 6.

Figure 2:
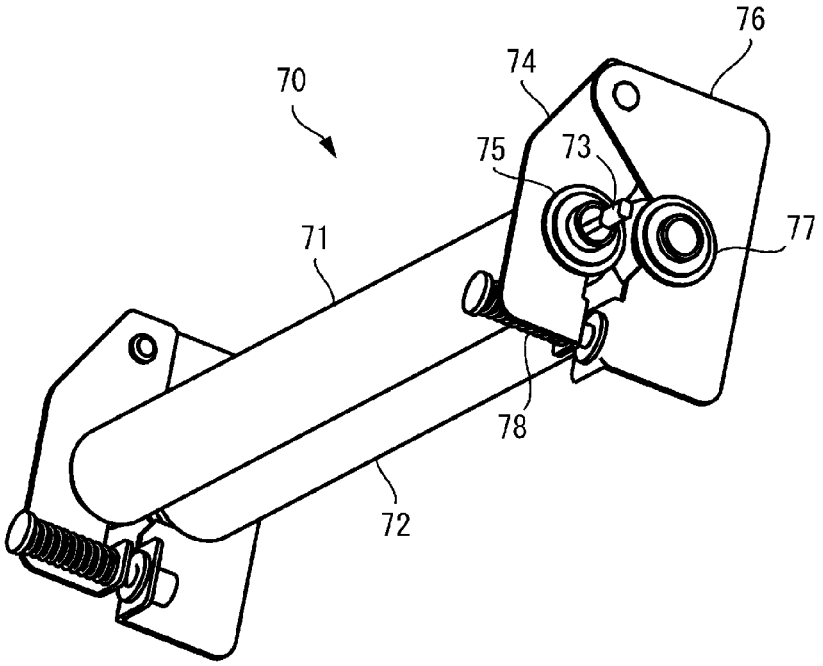
FIG. 2 is a perspective view showing a principal part of a fixing device.

The fixing device 70 includes the fixing roller 71 and the pressing roller 72 as a pair of rotatable member in order to fix the transferred toner image under application of heat and pressure as shown in FIG. 2. The fixing roller 71 is hollow cylindrical member having a parting layer, at a surface thereof, having low friction coefficient, and is provided a halogen heater 73 therein for heating the fixing roller 71. The fixing roller 71 is supported by a pressing lever 74 via a fixing roller bearing 75. The pressing roller 72 is supported by a supporting member 76 via a pressing roller bearing 77. The pressing lever 74 and the supporting member 76 are connected swingably with each other, and an urging spring 78 for urging the pressing lever 74 and the supporting member 76 in a closing direction in a close state, so that a pressing force (urging force) acts between the fixing roller 71 and the pressing roller 72.

Figure 4:
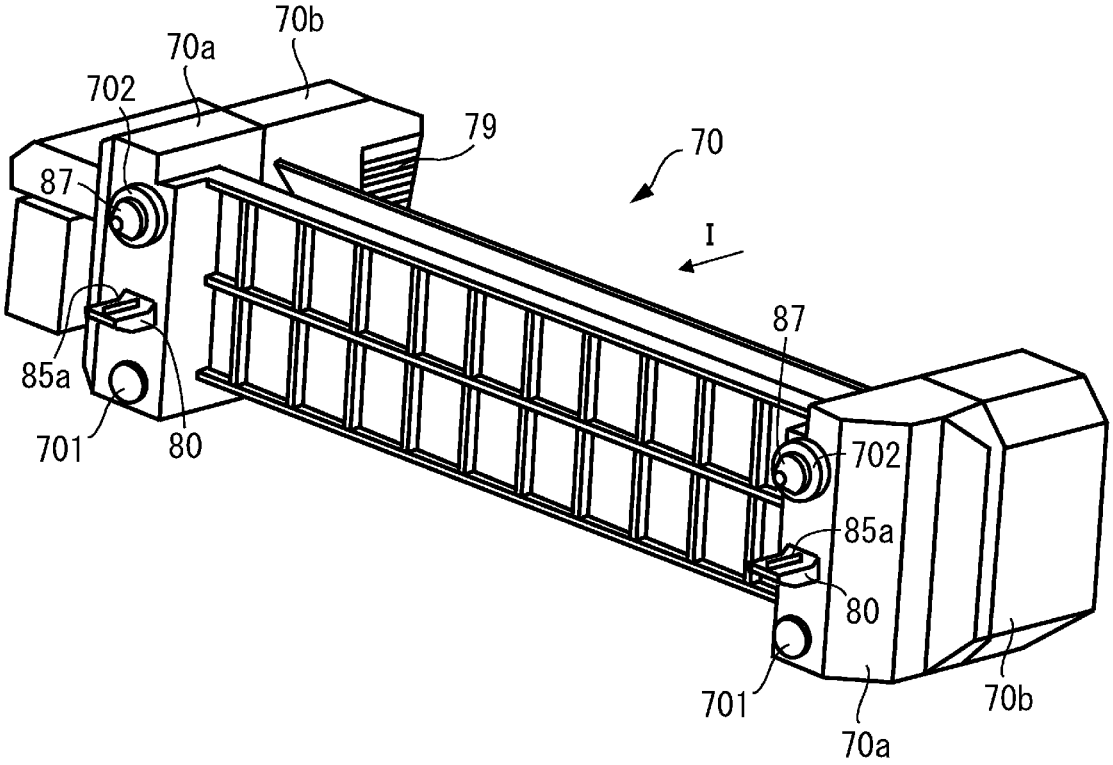
FIG. 4 is a perspective view, as seen from a rear side of the insertion direction, showing a schematic structure of the fixing device in a state in which the fixing device is dismounted from the apparatus main assembly.

The fixing roller 71, the pressing roller 72, the pressing lever 74, the supporting member 76 and the like which are described above are incorporated in a fixing frame 70*a* and a fixing cover 70*b* as shown in FIG. 4. In a side opposite from an insertion direction of the fixing cover 70*b*, i.e., in the front side, a grip portion 79 capable of being gripped by the user with hands (fingers) is formed.

Figure 5:
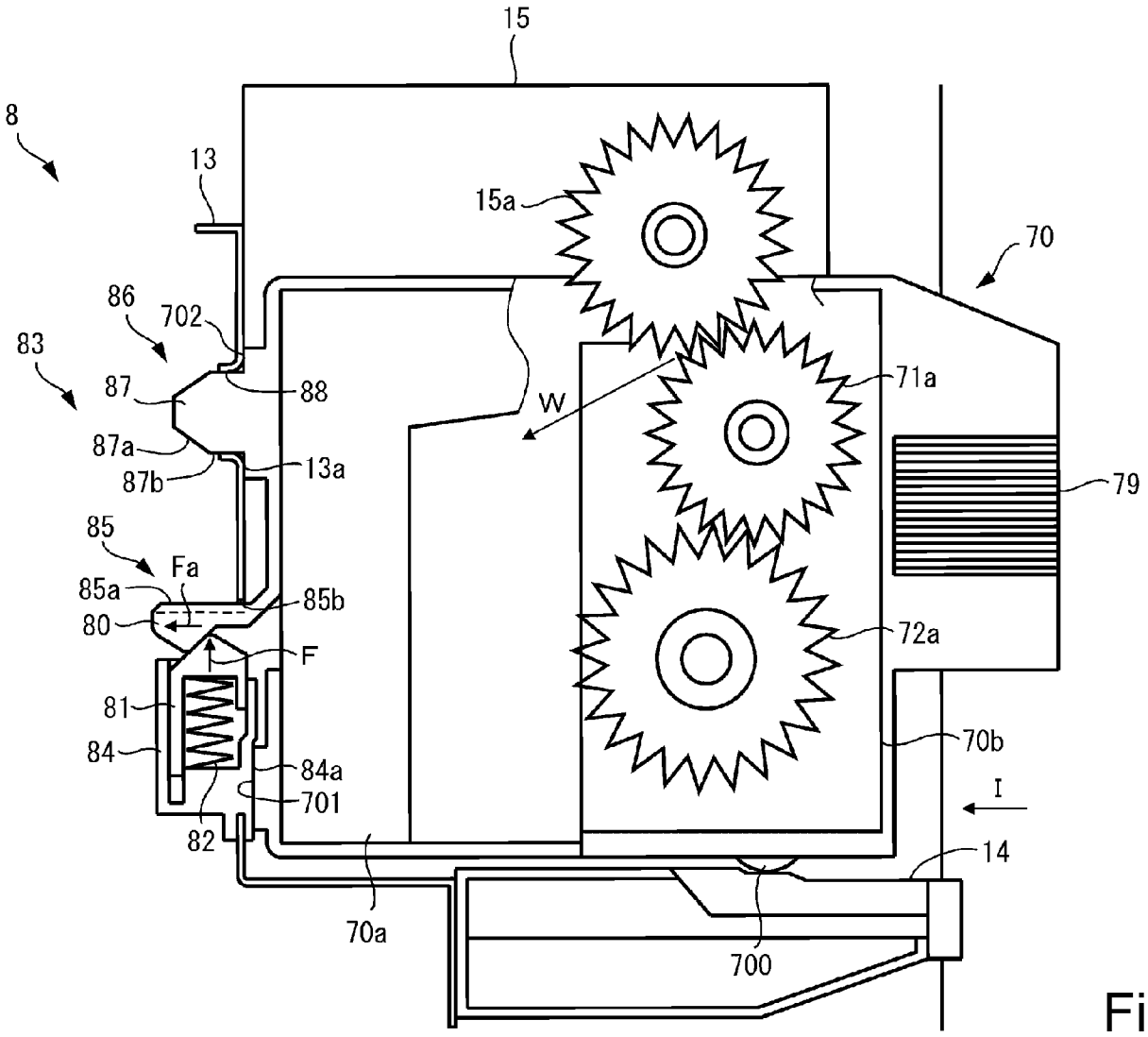
FIG. 5 is a sectional view showing the schematic structure of the fixing device in the state in which the fixing device is mounted to the apparatus main assembly.

The fixing device 70 is provided with an input gear 71*a*, and at an end portion of the pressing roller 72, a roller gear 72*a* is provided. As shown in FIG. 5, a driving gear 15*a* of a driving portion 15 described later engages with the input gear 71*a* and the roller gear 72*a* in the listed order, and a rotational force from the driving portion 15 is transmitted to the pressing roller 72, so that the fixing roller 71 is rotated by the pressing roller 72. By passing the sheet S between the rotating pressing roller 72 and the fixing roller 71 rotated by the rotation of the pressing roller 72, the (unfixed) toner image (not shown) on the sheet S is fixed under application of heat and pressure, and then is conveyed toward the downstream side. As shown in FIG. 5, arrangement of the driving gear 15*a* and the input gear 71*a* is set so that an acting direction at a tangential force W of each of the gears 15*a* and 71*a* substantially coincides with a direction of a component force Fa of an urging spring 82 described later and so that the tangential force W passes between a first bearing surface 701 and a second bearing surface 702.

Figure 3:
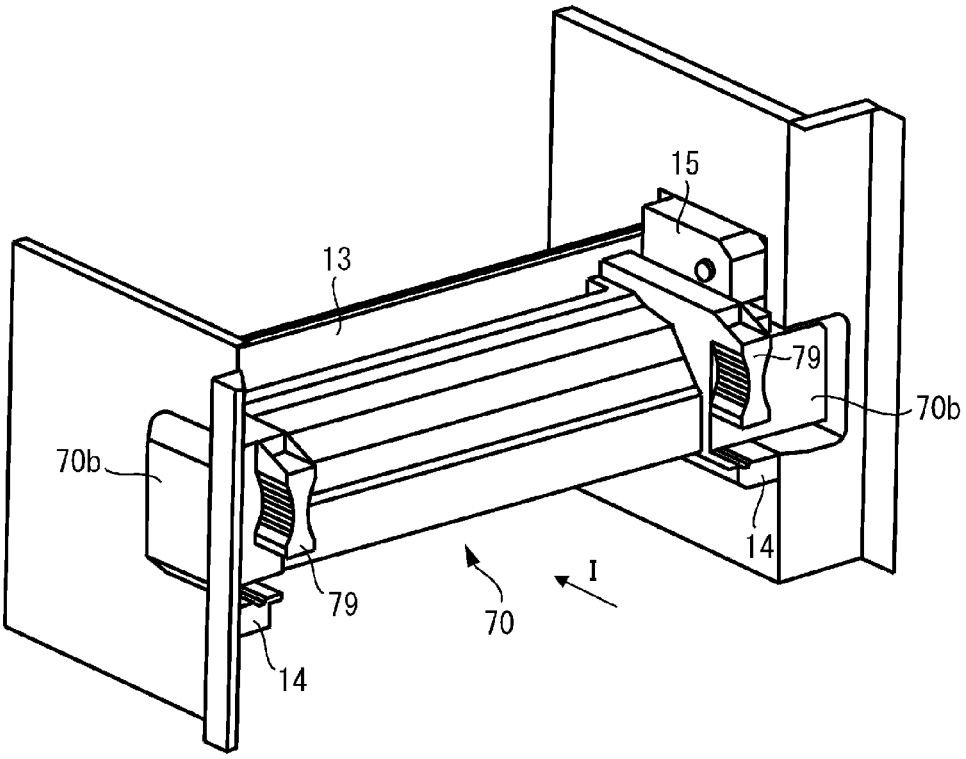
FIG. 3 is a perspective view, as seen from a front side of an insertion direction, showing a schematic structure of the fixing device in a state in which the fixing device is mounted to an apparatus main assembly.

Further, as shown in FIG. 3, the main assembly frame 13 is provided with a supporting portion (guiding mechanism) 14 for supporting the fixing device 70 and is provided with the driving portion 15 for rotating the fixing roller 71 and the pressing roller 72. The supporting portion 14 is a rail-shaped guiding mechanism provided along an insertion direction I as shown in FIG. 5. Specifically, the supporting portion 14 guides mounting movement of the fixing device 70 *s* that a fixing device mounting direction is the insertion direction I while sliding on a slider 700 formed at a lower surface of the fixing cover 70*b* of the fixing device 70 mounted from above. When the fixing device is taken out, a dismounting direction is opposite from the insertion direction I.

As shown in FIGS. 4 and 5, at a rear-side end portion of the fixing device 70 with respect to the insertion direction I, the first bearing surface 701 disposed at a lower portion and the second bearing surface 702 disposed above the first bearing surface 701 are formed. The first bearing surface 701 is contactable to a contact surface 84*a* of a holder 84 described later, and the second bearing surface 702 is contactable to a contact surface 13*a* at a periphery of a position hole 88 described later. When the fixing device 70 is inserted into the apparatus main assembly 10 to reach a rearmost portion (mounting position), the first bearing surface 701 contacts the contact surface 84*a*, and the second bearing surface contacts the contact surface 13*a*, so that the fixing device 70 is positioned with respect to the insertion direction I.

The driving portion 15 is provided at a position where the driving gear 15*a* and the input gear 71*a* engage with each other when the fixing device 70 is positioned at the rearmost portion of the apparatus main assembly 10.

The unit fixing device 8 will be specifically described with reference to FIGS. 4 to 7.

As shown in FIG. 5, the unit fixing device 8 includes a pressure receiving member (engaging member) 80, a pressure applying member (advancing-and-retracting member) 81, the urging spring (urging member) 82 and a preventing portion 83. In this embodiment, the pressure receiving member 80 and the pressure applying member 81 are provided to the fixing device 70 and the apparatus main assembly 10, respectively.

The pressure receiving member 80 is, as shown in FIGS. 4 and 5, provided in the neighborhood of each of widthwise ends of the fixing device at an end surface in the insertion direction I side. As shown in (a) of FIG. 7, the pressure receiving member 80 includes a portion-to-be-engaged 80*a* where a guiding surface (retracting portion) 80*b* and a maintaining surface (permitting portion) 80*c* which are inclined surfaces each inserted with respect to the insertion direction I are formed. The guiding surface 80*b* is disposed in the front side of the insertion direction I extending downward toward the front side of the fixing device 70, and is the inclined surface inclined at an inclination angle of θ3°, 30 degrees in this embodiment. Further, the maintaining surface 80*c* is disposed in the rear side of the insertion direction I while continuously extending from the guiding surface 80*b* and extending downward toward the rear side of the fixing device 70, and is the inclined surface inclined at an inclination angle of θ4°, i.e., 45 degrees in this embodiment.

Figure 6:
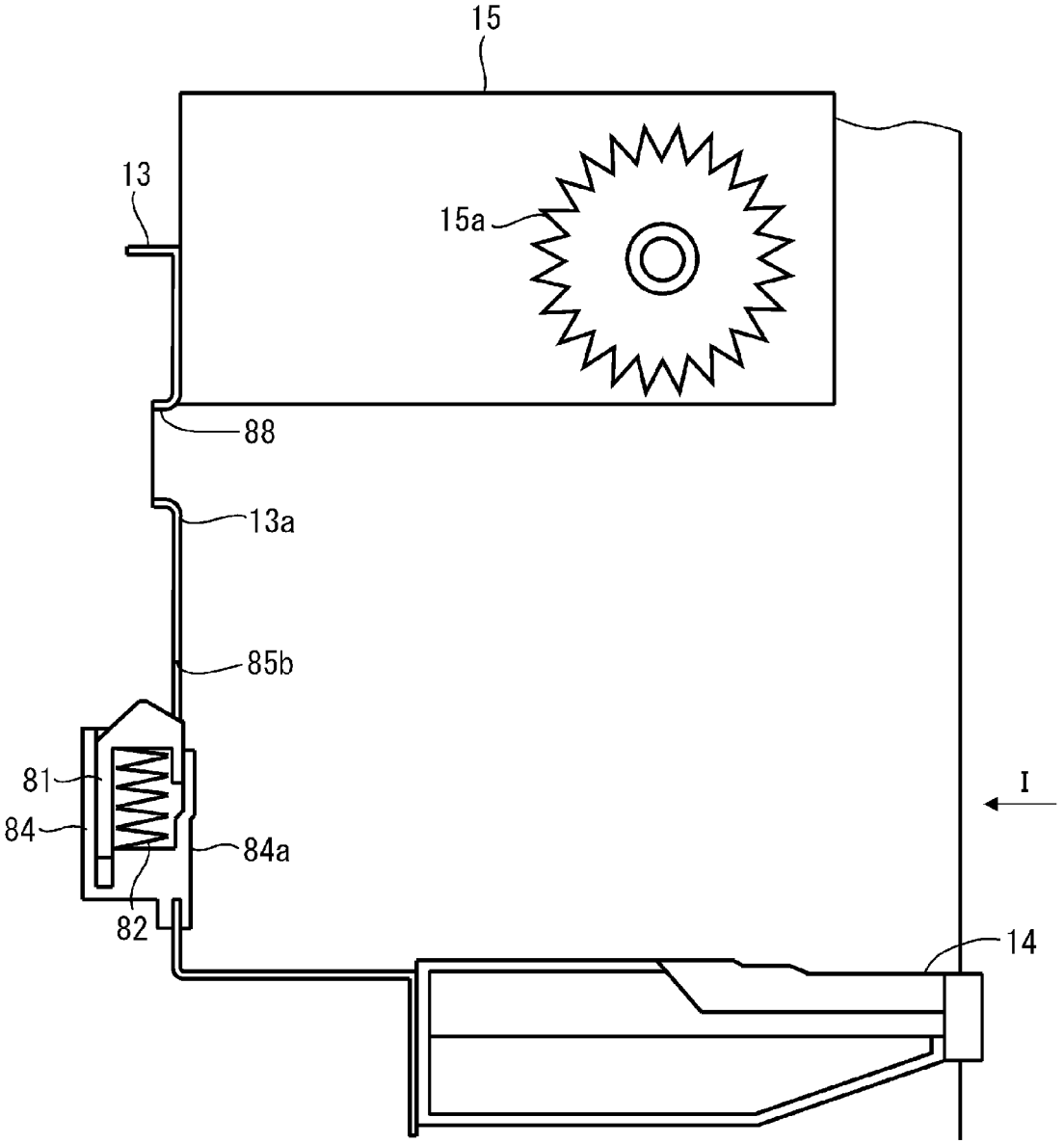
FIG. 6 is a sectional view showing the schematic structure of the fixing device in the state in which the fixing device is dismounted from the apparatus main assembly.
Figure 7:
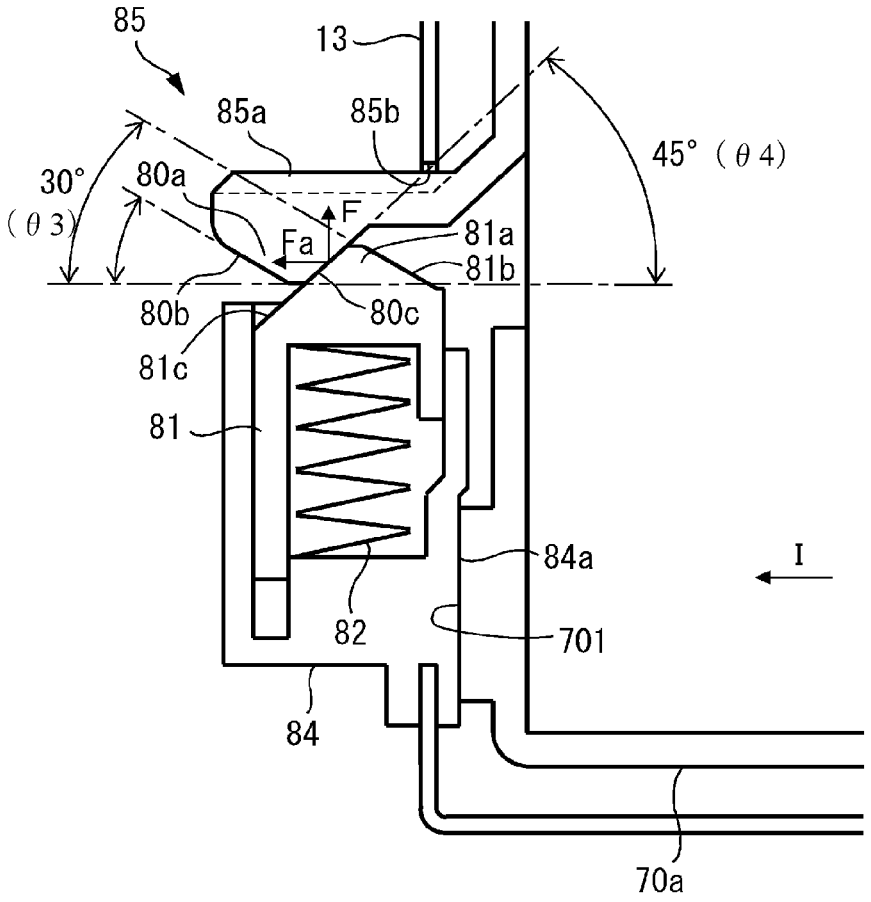
In FIG. 7, (a) is an enlarged sectional view showing a pressure receiving member, a pressure applying member and a first preventing portion, and (b) is an enlarged view showing a principal part of the pressure applying member.
Figure 7:
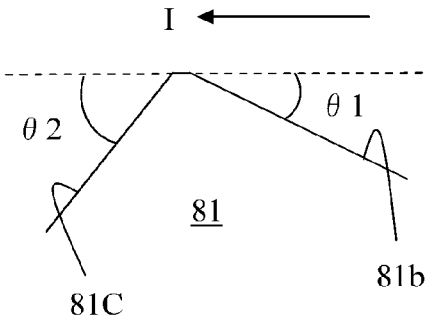

The pressure applying member 81 is, as shown in FIGS. 6 and 7, provided at a position where the pressure applying member 81 opposes the pressure receiving member 80 of the main assembly frame 13. The pressure applying member 81 is supported by the holder (guiding member) 84 fixed to the main assembly frame 13 so as to be capable of advancing and retracting in an up-down direction (advancing direction (upward direction in FIG. 7) and retracting direction (downward direction in FIG. 7)). In this embodiment, a position where the pressure applying member 81 advances to an uppermost portion is referred to as a rising-side position, and a position where the pressure applying member 81 retracts to a lowermost portion is referred to as a setting-side position. The urging spring 82 consisting of a compression coil spring is provided between the pressure applying member 81 and the holder 84, and always urges the pressure applying member 81 toward the advancing direction (upward direction in FIG. 7) relative to the holder 84. This advancing-and-retracting direction (advancing direction and retracting direction) of the pressure applying member 81 is a direction substantially perpendicular to the insertion direction I of the fixing device. These directions are not limited to an example in which the directions are completely perpendicular to each other, but may also be the case where the directions are inclined slightly from a perpendicular state with play (tolerance).

The pressure applying member 81 is, as shown in FIG. 7, provided with an engaging portion 81*a* where a guiding surface 81*b* and a maintaining surface 81*c* which are inclined surfaces each inserted with respect to the insertion direction I are formed. The guiding surface 81*b* is disposed in the rear side of the insertion direction I extending upward toward the rear side of the fixing device 70, and is the inclined surface inclined at an inclination angle of θ1°, 30 degrees in this embodiment. Further, the maintaining surface 81*c* is disposed in the front side of the insertion direction I while continuously extending from the guiding surface 81*b* and extending upward toward the front side of the fixing device 70, and is the inclined surface inclined at an inclination angle of θ2°, i.e., 45 degrees in this embodiment.

The engaging portion 81*a* of the pressure applying member 81 is engageable with the portion-to-be-engaged 80*a* of the pressure receiving member 80. When the fixing device 70 is inserted into the apparatus main assembly 10, first, the guiding surfaces 80*b* and 81*b* are contacted and slid with each other, so that the pressure receiving member 80 guides the pressure applying member 81 toward the setting-side position against an urging force F of the urging spring 82 (inserted state).

The pressure applying member 81 rides over the pressure receiving member 80 (FIG. 8), and the urging force F of the urging spring 82, so that the maintaining surfaces 80*c* and 81*c* are contacted and slid with each other, and thus engagement between the engaging portion 81*a* and the portion-to-be-engaged 80*a* is maintained (mounted state). At this time, the engaging portion 81*a* urges the portion-to-be-engaged 80*a* upward by the urging force F of the urging spring 82, and therefore the component force Fa for urging the fixing device 70 in the insertion direction I is generated by the contact between the maintaining surfaces (inclined surfaces) 80*c* and 81*c*. By this component force Fa, a drawing force (moving force) for drawing (moving) the fixing device 70 toward the inside of the apparatus main assembly 10 acts on the fixing device 70.

The preventing portion 83 includes, as shown in FIG. 5, a first preventing portion 85 provided on or above the pressure receiving member 80 and the pressure applying member 81 and a second preventing portion 86 provided above the first preventing portion 85.

The first preventing portion 85 includes a rib 85*a* (FIG. 4) as an engaging portion which is formed no an upper surface of the pressure receiving member 80 and which extends in a longitudinal direction coinciding with the insertion direction I, and includes a preventing hole 85*b* as a portion-to-be-engaged formed in the main assembly frame 13. The rib 85*a* corresponds to a constituent portion as a part of the preventing portion 83.

The pressure receiving member 80 is disposed so as to be capable of passing through the preventing hole 85*b*, and is prevented from moving upward by contact of an upper end portion of the rib 85*a* with an upper edge portion (stopper portion) of the preventing hole 85*b*. The rib 85*a* is formed at the upper surface of the pressure receiving member 80, and is disposed in a side opposite from the portion-to-be-engaged 80*a*. For this reason, when the pressure receiving member 80 is pushed up from below by the pressure applying member 81, the upper end portion of the rib 85*a* is urged against the upper edge portion of the preventing hole 85*b*, so that the position of the fixing device with respect to the up-down direction (the advancing direction of the pressure applying member 81) is determined. That is, at this time, the pressure receiving member 80 is in a state in which the pressure receiving member 80 is sandwiched between the pressure applying member 81 and the edge portion (stopper portion) of the preventing hole 85*b*.

The second preventing portion 86 includes a positioning shaft 87 (FIG. 4) which is provided above the pressure receiving member 80 and which projects in the insertion direction I, and includes a positioning hole 88 formed in the main assembly frame 13. The positioning shaft 87 is provided coaxially with the second bearing surface 702. The positioning shaft 87 includes a tapered portion 87*a* provided in the front side of the insertion direction I and includes a cylindrical positioning portion 87*b* continued from the tapered portion 87*a*. A projection length of the positioning shaft 87 in the insertion direction I is set smaller than the rib 85*a*. The positioning hole 88 is a hole having the substantially same diameter as the positioning portion 87*b* and is provided with a flange extending from an end portion in the insertion direction I.

In the case where the fixing device 70 is mounted in and dismounted from the apparatus main assembly 10, when the guiding surfaces 80*b* and 81*b* contact each other, at the second preventing portion 86, the tapered portion 87*a* is positioned in the positioning hole 88 and is movable in a direction crossing the insertion direction I. At the same time, at the first preventing portion 85, the rib 85*a* contacts the preventing hole 85*b* and is positioned with respect to the upward direction. Further, in the case where the fixing device 70 is mounted in and dismounted from the apparatus main assembly 10, when the maintaining surfaces 80*c* and 81*c* contact each other, at the first preventing portion 85, the rib 85*a* does not contact the preventing hole 85*b*, but at the second preventing portion 86, the positioning portion 87*b* is inserted in the positioning hole 88. As a result, the fixing device 70 is positioned relative to the apparatus main assembly 10 with respect to the direction crossing the insertion direction I.

That is, the first preventing portion 85 prevents movement of the fixing device 70 in the setting-side direction caused by the urging spring 82 in a period from the contact between the engaging portion 81*a* and the portion-to-be-engaged 80*a* until the pressure applying member 81 rides over the pressure receiving member 80. Further, the second preventing portion 86 prevents movement of the fixing device 70 in the setting-side direction caused by the urging spring 82 after the pressure applying member 81 rides over the pressure receiving member 80 when the fixing device 70 is inserted into the apparatus main assembly 10. Further, the preventing portion 83 prevents movement of the fixing device 70 in the setting-side direction caused by the urging spring 82 at least at the time when the pressure applying member 81 rides over the pressure receiving member 80 when the fixing device 70 is inserted into the apparatus main assembly 10.

Next, an operation of the unit fixing device 8 when the fixing device 70 in this embodiment is mounted to the main assembly frame 13 will be described with reference to FIGS. 5 and 7.

During the image formation, the fixing device 70 is mounted in the apparatus main assembly 10 and is engaged with and fixed to the main assembly frame 13 by the unit fixing device 8, and is disposed in a state in which the outer cover 12 is closed. At this time, the pressure receiving member 80 is engaged with the pressure applying member 81 and the positioning shaft 87 is positioned by being inserted into the positioning hole 88. The first and second bearing surfaces 701 and 702 are positioned by being contacted to the contact surfaces 84*a* and 13*a*, respectively.

The pressure applying member 81 is urged by the urging spring 82, and therefore the urging force F acts upward. The urging force F is transmitted to the maintaining surface 80*c* of the pressure receiving member 80 via the maintaining surface 81*c* of the pressure applying member 81. Further, the maintaining surfaces 81*c* and 80*c* are the inclined surfaces inclined downward toward the front side of the insertion direction I, and therefore the component force Fa of the urging force F acts on the main assembly frame 13 in the insertion direction I. The pressure receiving member 80 is provided integrally with the fixing frame 70*a*, and therefore the fixing device 70 is drawn (moved) in the insertion direction I by the component force Fa. Accordingly, it is possible to alleviate an insertion load when the user inserts the fixing device into the apparatus main assembly.

With respect to the fixing device 70 drawn in the insertion direction I, the first and second bearing surfaces 701 and 702 abut against the contact surfaces 84*f* and 13*a*, respectively, so that a part of the component force Fa acts on the fixing device 70. By this component force Fa, the fixing device 70 is held in the main assembly frame 13, and thus an image formable state is created.

Further, during the image formation in a state in which the fixing device 70 is mounted in the apparatus main assembly 10, in order to convey the sheet S, the rotational driving force is inputted into the pressing roller 72, so that the fixing roller 71 is rotated by the pressing roller 72. At the engaging portion between the driving gear 15*a* of the driving portion 15 as a driving source and the input gear 71*a* of the direction 70, the gear tangential force W (FIG. 5) acts in a tangential direction between the gears 15*a* and 71*a*. That is, the above-described component force Fa acts on the fixing device 70 during non-image formation, and during the image formation, in addition to the component force Fa, a component force of the gear tangential force along the insertion direction I acts on the fixing device 70. For that reason, a devising for preventing deviation of the position of the fixing device is further made.

Here, a maintaining force is decreased when the tangential force W during the image formation is directed in a reaction force direction of the component force Fa as the maintaining force for maintaining the fixing device 70 in the main assembly frame 13. Therefore, in this embodiment, the arrangement of the driving gear 15*a* and the input gear 71*a* is set so that the tangential force W generates the component force along the insertion direction I. Further, when the tangential force W is directed in a direction in which a moment force is applied to the first and second bearing surfaces 701 and 702, the fixing device 70 is rotated by the tangential force W. Therefore, in this embodiment, in order to prevent the application of such moment, the arrangement of the driving gear 15*a* and the input gear 71*a* is set so that the tangential forced W passes between the first and second bearing surfaces 701 and 702.

Next, an operation of the unit fixing device 8 when the fixing device 70 in this embodiment is mounted in the main assembly frame 13 will be described with reference to FIGS. 5 to 8.

As shown in FIG. 6, in a state in which the fixing device 70 is dismounted from the main assembly frame 13, there is no pressure receiving member 80, and therefore the pressure applying member 81 is raised by the urging force F of the urging spring 82. For this reason, the pressure applying member 81 stands by at position somewhat above a position thereof when the fixing device 70 is mounted, and is held by the holder 84.

When the user opens the outer cover 12 and gradually inserts the fixing device 70 along the insertion direction I while gripping the grip portion 79, the guiding surface 80*b* of the pressure receiving member 80 contacts the guiding surface 81*b* of the pressure applying member 81. This state is a state in which the guiding surface 81*b* of the pressure applying member 81 raises the fixing device 70 in the fixing frame 70*a* side while applying the weight of the fixing device 70 from the slider 700 to the supporting portion 14. In this state, the weight of the direction 70 is not so applied from the guiding surface 80*b* of the pressure receiving member 80 to the guiding surface 81*b* of the pressure applying member 81. For this reason, the guiding surface 80*b* of the pressure receiving member 80 merely contacts the guiding surface 81*b* of the pressure applying member 81, so that an acting force to the extent that the pressure applying member 81 is pushed down does not act on the pressure applying member 81.

When the fixing device 70 is further inserted, the guiding surface 80*b* of the pressure receiving member 80 slides upward on the guiding surface 81*b* of the pressure applying member 81. When the fixing device 70 is further inserted, the rib 85*a* formed on the pressure receiving member 80 contacts the upper edge portion of the preventing hole 85*b* of the main assembly frame 13. By the contact between the rib 85*a* and the upper edge portion of the preventing hole 85*b*, a place-to-go of the fixing device 70 with respect to a height direction is limited, and therefore the guiding surface 80*b* of the pressure receiving member 80 does not slide upward on the guiding surface 81*b* of the pressure applying member 81.

When the fixing device 70 is further inserted, the rib 85*b* contacts the upper edge portion (stopper), so that the pressure receiving member 80 is not raised by a height not less than a certain height. Therefore, by the action of inclination of each of the guiding surfaces 80*b* and 81*b*, the guiding surface 80*b* of the pressure receiving member 80 starts the pressing-down of the pressure applying member 81 against the urging force F of the urging spring 82.

Figure 8:
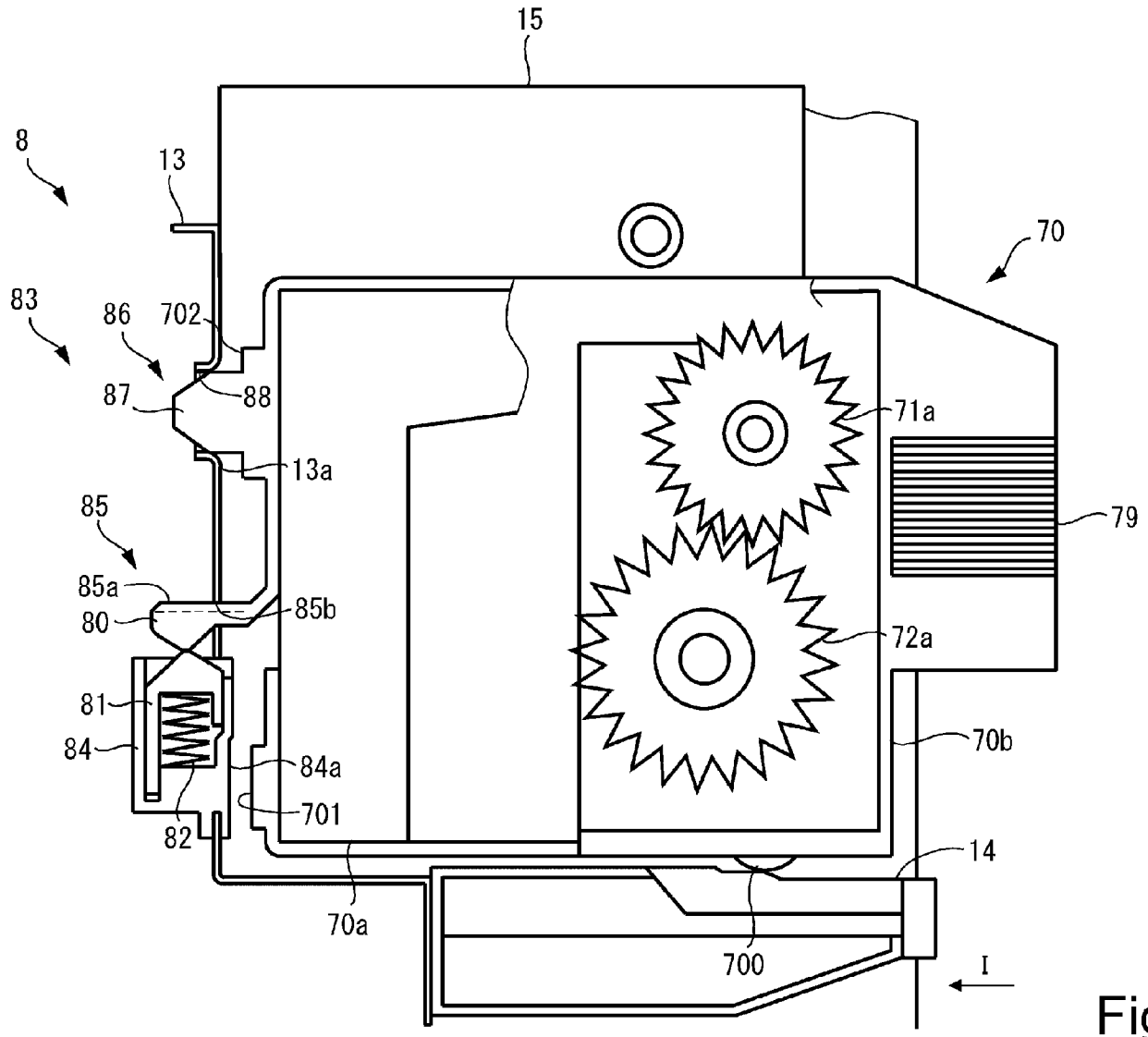
FIG. 8 is a sectional view showing a schematic structure of the fixing device in a state in which the fixing device is mounted into and dismounted from the apparatus main assembly partway.

When the fixing device 70 is further inserted, as shown in FIG. 8, a vertex of the portion-to-be-engaged 80*a* of the pressure receiving member 80 and a vertex of the engaging portion 81*a* of the pressure applying member 81 substantially coincide with each other. This state provide a point of change where an insertion load necessary to insert the direction 70 is changed. A length of the positioning shaft 87 and dimensions and the like of the portion-to-be-engaged 80*a* and the engaging portion 81*a* are determined so that the positioning shaft 87 and the positioning hole 88 start engagement therebetween from the point of change and so that the rib 85*a* and the upper edge portion of the preventing hole 85*b* are spaced from each other from the point of change.

When the fixing device 70 is further inserted, by the inclination of each of the maintaining surfaces 80*c* and 80*c*, the component force Fa directed in the insertion direction I is generated from the urging force F. Then, the fixing device 70 is inserted until the first and second bearing surfaces 701 and 702 abut against the contact surfaces 84*a* and 13*a*, respectively, thus being placed in the mounted state.

Here, in the above-described procedure, the user performs the inserting operation by gripping the grip portion 79, but the present invention is not limited thereto. For example, the user may also perform the closing operation of the outer cover 12 in a state in which the fixing device 70 is only placed on the main assembly frame 13 without being inserted completely to the end. In this case, when the outer cover 12 is closed, the outer cover 12 contacts the grip portion 79 of the fixing device 70 from a predetermined closing angle, and in interrelation with the closing operation of the outer cover 12, the fixing device 70 is inserted into the main assembly frame 13 in the insertion direction I. When the outer cover 12 is further closed, similarly as the inserting operation of the fixing device 70 by the manual operation described above, the pressure receiving member retracts the pressure applying member and passes through the point of change. Then, the fixing device 70 is to be automatically drawn to a final set position by the drawing force Fa.

For this reason, in the case where the user manually performs the inserting operation of the fixing device 70, even when the fixing device 70 is insufficiently pushed in, thereafter the user closes the outer cover 12 and thus the fixing device 70 is held by the apparatus main assembly at the final set position, so that it is possible to prevent an erroneous operation.

Next, an operation of the unit fixing device 8 when the fixing device 70 in this embodiment is pulled out from the main assembly frame 13 will be described with reference to FIGS. 5 to 8.

As shown in FIG. 5, in the mounted state in which the fixing device 70 is mounted in the apparatus main assembly 13, the maintaining surface 81*c* of the pressure applying member 81 and the maintaining surface 80*c* of the pressure receiving member 80 contact each other, and the urging force F acts, and the positioning shaft 87 engages with the positioning hole 88. From this state, when the fixing device 70 is pulled out toward a side opposite from the insertion direction I, as shown in FIG. 8, the vertex of the portion-to-be-engaged 80*a* of the pressure receiving member 80 and the vertex of the engaging portion 81*a* of the pressure applying member 81 substantially coincide with each other.

This state provides a point of change where a dismounting load necessary to dismount the fixing device 70 is changed. From this point of change, the positioning shaft 87 and the positioning hole 88 start disengagement therebetween, and the rib 85*a* contacts the upper edge portion of the preventing hole 85*b*. This state is the same state as the point of change in a halfway process when the fixing device 70 is inserted as described above, and when the fixing device 70 is further pulled out from this state, by an operation reverse to the operation during the insertion, the fastening of the fixing device 70 to the apparatus main assembly 10 is eliminated, so that the fixing device 70 can be taken out.

Here, a force required when the fixing device 70 is inserted, a maintaining force and a force required when the fixing device 70 is pulled out will be described.

In the mounted state of the fixing device 70, the maintaining surfaces 80*c* and 81*c* contact each other at the inclination angle of 45 degrees with respect to the insertion direction I. On the other hand, in the inserted state of the fixing device 70, the guiding surfaces 80*b* and 81*b* contact each other at the inclination angle of 30 degrees with respect to the insertion direction I. Here, a magnitude of the component force Fa of the urging force F is correlated with a component force of the urging force F along the contact surface. The maintaining surfaces 80*c* and 81*c* in the mounted state contact each other at the inclination angle of 45 degrees, and therefore a component force of (urging force F)×sin 45° is generated along the maintaining surfaces 80*c* and 81*c*. The guiding surfaces 80*b* and 81*b* in the inserted state contact each other at the inclination angle of 30 degrees, and therefore a component force of (urging force F)×sin 30° is generated. Here, (urging force F)×sin 45°>(urging force F)×sin 30° holds, and therefore the component force Fa of the urging force F is larger in a later-stage state of the insertion than in an initial-stage state of the insertion. In this way, the inclination angle of the guiding surfaces 80*b* and 81*b* contacting each other in the initial-stage state of the insertion is made smaller than the inclination angle of the maintaining surfaces 80*c* and 81*c* contacting each other in the later-stage state of the insertion, whereby it is possible to reduce the necessary insertion force in the initial-stage state of the insertion. As a result, the operation when the fixing device 70 is mounted becomes easy, and the fixing device 70 is firmly fixed at the final set position.

As described above, according to the image forming apparatus 1 in this embodiment, by inserting the fixing device 70 into the apparatus main assembly 10, the pressure applying member 81 rides over the guides with the pressure receiving member 80, so that the fixing device 70 and the apparatus main assembly 10 are fixed with each other. For this reason, the fixing device 70 can be fixed only by being inserted into the apparatus main assembly 10, and the fixing can be eliminated only by pulling out the fixing device 70 from the apparatus main assembly 10. For this reason, a mounting and dismounting operation property of the fixing device 70 can be improved. In addition, the preventing portion 83 prevents movement of the pressure applying member for the fixing device 70 in the raising and setting directions, so that reliability of the fixing between the fixing device 70 and the apparatus main assembly 10 can be enhanced.

Further, according to the image forming apparatus 1 in this embodiment, the first and second preventing portions 85 and 86 are separately disposed in a spaced state, and therefore when the operation is switched between the inserted state and the mounted state, it is possible to reliably realize the switching between the first and second preventing portions 85 and 86 with a simple constitution.

Further, according to the image forming apparatus 1 in this embodiment, the pressure receiving member 80 is integrally formed with the rib 85*a*, and therefore it is possible to suppress the number of components. In addition, the rib 85*a* contacts the upper edge portion of the preventing hole 85*b*, and therefore compared with the case where the upper surface of the pressure receiving member 80 surface-contacts the upper edge portion of the preventing hole 85*b* without providing the rib 85*a*, it is possible to reduce the friction resistance at the first preventing portion 85. As a result, the force necessary to insert the fixing device 70 is suppressed, so that operativity can be improved.

In this embodiment described above, the pressure receiving member 80 and the pressure applying member 81 are provided with the guiding surfaces 80*b* and 81*b*, respectively, but the present invention is not limited thereto. The guiding surfaces 80*b* and 81*b* may only be required to be provided on at least one of the pressure receiving member 80 and the pressure applying member 81. Similarly, the pressure receiving member 80 and the pressure applying member 81 are provided with the maintaining surfaces 80*c* and 81*c*, respectively, but the present invention is not limited thereto. The maintaining surfaces 80*c* and 81*c* may only be required to be provided on at least one of the pressure receiving member 80 and the pressure applying member 81. Further, each of the inclined surfaces formed on the pressure receiving member 80 and the pressure applying member 81 may also be shaped so as not to be linearly inclined with respect to the insertion direction I. For example, the inclined surfaces can also be a curved surface or a stepped surface.

Further, in this embodiment described above, the pressure receiving member 80 is formed integrally with the rib 85*a* but the present invention is not limited thereto. The rib 85*a* may also be formed as a separate member. Further, the first and second preventing portions 85 and 86 are separately disposed in the spaced state, but the present invention is not limited thereto. These preventing portions may also be formed integrally with each other.

Further, in this embodiment described above, the positioning shaft 87 is provided with the tapered portion 87*a* in the front side of the insertion direction I, but the present invention is not limited thereto. The positioning shaft 87 may also be not provided with the tapered portion 87*a*. Also in this case, the first preventing portion 85 performs positioning in the inserted state, and therefore it is possible to fasten the fixing device 70 and the apparatus main assembly 10 with reliability.

Further, in this embodiment described above, as the fixing device 70, the case where a type in which the pair of press-contact rollers is used is employed is described, but the present invention is not limited thereto. For example, it is also possible to employ a constitution in which a belt is used in the pressing roller side or the fixing roller side.

Further, in this embodiment described above, the pressure receiving member 80 is provided to the fixing device 70 and the pressure applying member 81 is provided to the apparatus main assembly 10, but the present invention is not limited thereto. In a reverse manner, the pressure receiving member 80 may also be provided to the apparatus main assembly 10 and the pressure applying member 81 may also be provided to the fixing device 70. Incidentally, it is preferable from the viewpoint of easy recycling property that the pressure receiving member increased in number of components such as the spring is provided in the apparatus main assembly side compared with the pressure applying member, and is continuously used in the image forming apparatus.

Further, in this embodiment described above, the case where the fixing device 70 is used as a unit detachably mountable to the apparatus main assembly 10 is described, but the present invention is not limited thereto. For example, as the unit, a device in which the image forming units 31*y*, 31*m*, 31*c* and 31*k* and the secondary transfer portion 34 and the like are assembled into a unit may also be used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 189646/2013 filed Sep. 12, 2013, which is hereby incorporated by reference.

What is claimed is:

1. An electrophotographic image forming apparatus comprising:

a main assembly including an image forming portion configured to form a toner image on a sheet; and a fixing unit, detachably mountable to said main assembly, configured to fix the toner image formed on the sheet by the image forming portion, wherein said main assembly includes (i) an advancing-and-retracting member capable of advancing and retracting linearly, (ii) a regulating member configured to regulate an advancing direction and a retracting direction of said advancing-and-retracting member so that the advancing and retracting directions are substantially perpendicular to a mounting direction of said fixing unit and are linear directions, and (iii) an urging member configured to urge said advancing-and-retracting member in the advancing direction, and wherein said fixing unit includes an engaging member engageable with said advancing-and-retracting member, and wherein the engaging member includes (i) a retracting portion configured to retract said advancing-and-retracting member against an urging force of said urging member with a mounting operation of said fixing unit to said main assembly, and (ii) a permitting portion configured to (a) permit advancing of said advancing-and-retracting member by the urging force and (b) receive a force for moving said fixing unit in the mounting direction from said advancing-and-retracting member, with a further mounting operation of said fixing unit to said main assembly.

2. An electrophotographic image forming apparatus according to claim 1, wherein said advancing-and-retracting member includes a first inclined surface which inclines with respect to the mounting direction and which is slidable with said retracting portion, and includes a second inclined surface which inclines with respect to the mounting direction and which is slidable with said permitting portion, and wherein the retracting portion includes a third inclined surface which inclines with respect to the mounting direction and which is slidable with the first inclined surface, and includes a fourth inclined surface which inclines with respect to the mounting direction and which is slidable with the second inclined surface.

3. An electrophotographic image forming apparatus according to claim 2, wherein an inclination angle θ2 of the second inclined surface is larger than an inclination angle θ1 of the first inclined surface.

4. An electrophotographic image forming apparatus according to claim 2, wherein each of the first inclined surface, the second inclined surface, the third inclined surface and the fourth inclined surface is a surface which linearly inclines with respect to the mounting direction.

5. An electrophotographic image forming apparatus according to claim 1, wherein said main assembly includes a hole portion configured to receive said engaging member with the mounting operation of said fixing unit into said main assembly, and includes a stopper portion configured to determine a position of said engaging member with respect to the advancing direction with an inserting operation of said engaging member into said hole portion.

6. An electrophotographic image forming apparatus according to claim 1, wherein said main assembly includes a guiding mechanism configured to guide mounting movement of said fixing unit into said main assembly.

7. An electrophotographic image forming apparatus comprising:

a main assembly; and a unit detachably mountable to said main assembly, wherein said main assembly includes (i) an advancing-and-retracting member capable of advancing and retracting linearly, (ii) a regulating member configured to regulate an advancing direction and a retracting direction of said advancing-and-retracting member so that the advancing and retracting directions are substantially perpendicular to a mounting direction of said unit and are linear directions, and (iii) an urging member configured to urge said advancing-and-retracting member in the advancing direction, and wherein said unit includes an engaging member engageable with said advancing-and-retracting member, and wherein the engaging member includes (i) a retracting portion configured to retract said advancing-and-retracting member against an urging force of said urging member with a mounting operation of said unit to said main assembly, and (ii) a permitting portion configured to (a) permit advancing of said advancing-and-retracting member by the urging force and (b) receive a force for moving said unit in the mounting direction from said advancing-and-retracting member, with a further mounting operation of said unit to said main assembly.

8. An electrophotographic image forming apparatus according to claim 7, wherein said advancing-and-retracting member includes a first inclined surface which inclines with respect to the mounting direction and which is slidable with said retracting portion, and includes a second inclined surface which inclines with respect to the mounting direction and which is slidable with said permitting portion, and wherein said retracting portion includes a third inclined surface which inclines with respect to the mounting direction and which is slidable with the first inclined surface, and includes a fourth inclined surface which inclines with respect to the mounting direction and which is slidable with the second inclined surface.

9. An electrophotographic image forming apparatus according to claim 8, wherein an inclination angle $\theta 2$ of the second inclined surface is larger than an inclination angle $\theta 1$ of the first inclined surface.

10. An electrophotographic image forming apparatus according to claim 8, wherein each of the first inclined surface, the second inclined surface, the third inclined surface and the fourth inclined surface is a surface which linearly inclines with respect to the mounting direction.

11. An electrophotographic image forming apparatus according to claim 7, wherein said main assembly includes a hole portion configured to receive said engaging member with the mounting operation of said unit into said main assembly, and includes a stopper portion configured to determine a position of said engaging member with respect to the advancing direction with an inserting operation of said engaging member into said hole portion.

12. An electrophotographic image forming apparatus according to claim 7, wherein said main assembly includes a guiding mechanism configured to guide mounting movement of said unit into said main assembly.

* * * * *